US007091915B1

(12) United States Patent
Truthan et al.

(10) Patent No.: US 7,091,915 B1
(45) **Date of Patent: *Aug. 15, 2006**

(54) GLASS-MOUNTED COUPLER AND PASSIVE GLASS-MOUNTED ANTENNA FOR SATELLITE RADIO APPLICATIONS

(75) Inventors: Robert Truthan, Cuyahoga Falls, OH (US); James Hadzoglou, Mayfield Heights, OH (US)

(73) Assignee: PCTEL Antenna Products Group, Inc., Bloomingdale, IL (US)

( * ) Notice: Subject to any disclaimer, the term of this patent is extended or adjusted under 35 U.S.C. 154(b) by 295 days.

This patent is subject to a terminal disclaimer.

(21) Appl. No.: 10/739,662

(22) Filed: Dec. 18, 2003

Related U.S. Application Data

(63) Continuation-in-part of application No. 10/175,770, filed on Jun. 20, 2002, now Pat. No. 6,690,330.

(60) Provisional application No. 60/324,337, filed on Sep. 24, 2001.

(51) Int. Cl.
*H01Q 1/32* (2006.01)

(52) U.S. Cl. ..... 343/715; 343/713

(58) Field of Classification Search ..... 343/711, 343/712, 713, 715, 841, 906; 333/24 C
See application file for complete search history.

(56) References Cited

U.S. PATENT DOCUMENTS

| | | | | |
|---|---|---|---|---|
| 5,451,966 | A | 9/1995 | Du et al. | 343/715 |
| 5,565,877 | A * | 10/1996 | Du et al. | 343/715 |
| 5,898,408 | A | 4/1999 | Du | 343/715 |
| 6,172,651 | B1 | 1/2001 | Du | 343/850 |
| 6,191,747 | B1 | 2/2001 | Cosenza | 343/749 |
| 6,359,593 | B1 * | 3/2002 | Marino et al. | 343/713 |
| 6,661,386 | B1 * | 12/2003 | Petros et al. | 343/713 |
| 6,690,330 | B1 * | 2/2004 | Truthan et al. | 343/713 |

* cited by examiner

*Primary Examiner*—Tan Ho
*Assistant Examiner*—Angela M Lie
(74) *Attorney, Agent, or Firm*—Gardner Carton & Douglas LLP

(57) ABSTRACT

An antenna system operable to receive radio frequency signals and operable to couple radio frequency energy through a dielectric panel. The system includes an exterior radio frequency coupling module having a plate and a shield electrically coupled to the plate. The exterior coupling module also has a conductive member electrically isolated from the plate and the shield. The system also includes an interior radio frequency coupling module having a plate and a shield electrically coupled to the plate. The interior coupling module includes a conductive member electrically isolated from the outer conductor and a shield. The exterior coupling module is affixed to one side of the dielectric panel and the interior coupling module is affixed to another side of the dielectric panel in juxtaposition to the exterior module. Both conductive members of the exterior and interior module contact the dielectric panel.

36 Claims, 12 Drawing Sheets

GLASS-MOUNTED COUPLER AND PASSIVE GLASS-MOUNTED ANTENNA FOR SATELLITE RADIO APPLICATIONS

CROSS-REFERENCE TO RELATED APPLICATIONS

This patent application is a continuation-in-part of U.S. patent application Ser. No. 10/175,770 filed Jun. 20, 2002 now U.S. Pat. No. 6,690,330, and claims the benefit of U.S. Provisional Patent Application No. 60/324,337, entitled "ON-GLASS COUPLER AND PASSIVE ON-GLASS ANTENNA FOR SATELLITE RADIO APPLICATIONS," filed on Sep. 24, 2001, the entire contents of which is incorporated herein by reference.

BACKGROUND OF THE INVENTION

The present invention relates to antenna systems for satellite radio communications, and more particularly, to a passive coupling device for a satellite radio antenna system.

Until relatively recently, satellite-based communication systems were used mainly for the transmission of telephone conversations and television broadcasts. Now satellite-based communication systems are being used to transmit radio broadcasts. In particular, the radio industry has recognized that satellite transmission of radio broadcasts allows listeners in cars, trucks, boats, and other vehicles to receive desired radio programming beyond the relatively limited geographic range associated with standard AM and FM radio broadcasting. Thus, for example, using satellite systems a listener can listen to the same radio station across an area of thousands of miles. An example of one currently available satellite radio broadcast service is the Satellite Digital Audio Radio Service ("SDARS").

In order to receive satellite broadcasts, vehicles must be equipped with proper antennas and receivers. Since most vehicles are not yet built with such antennas and receivers as standard equipment, satellite-capable antennas and receivers must be retrofitted on and in the vehicles. Mounting appropriate antennas on existing vehicles presents a particular challenge since it is preferred that the antenna be mounted on the exterior of the vehicle and the receiver be mounted in the interior of the vehicle. Of course, it is also preferred that a wired connection be made between the antenna and receiver.

In many retrofitting applications, glass-mounted antennas are used because of their easy installation. Installing a glass-mounted antenna does not require drilling holes in an exterior vehicle surface in order to mount the antenna and to connect a wire or cable between the antenna and receiver. Thus, a glass-mounted antenna avoids air and water leakage problems, and allows the antenna to be removed from the vehicle without sealing or repairing holes. Although temporarily installed magnet-mounted antennas are available, they are visually obtrusive and require the cable to be passed through an existing door or window opening. As a result, the cables are often damaged.

While glass-mounted radio frequency ("RF") coupling devices avoid the problems of conventional antennas, they introduce different concerns. Current glass-mounted RF coupling devices used in terrestrial cellular communication (which operate in the 800 and 1900 MHz frequency range) exhibit insertion loss characteristics of about 1½ to 2 dB. When these devices are used in a satellite radio transmission system (particularly those that operate above 1 GHz), the loss characteristics increase to an unacceptable level. Loss characteristics are not acceptable due to an increase in the system noise figure ("NF") from the coupler.

Some glass-mounted RF coupling devices compensate for their loss characteristics by using an externally-mounted, low-noise amplifier ("LNA") or other electronics to boost the received signal. While this arrangement may produce more acceptable characteristics, the externally mounted electronics are subjected to environmental hazards and possible tampering. An externally mounted LNA also requires an externally mounted power source or some sort of additional circuitry capable of powering the LNA. An additional DC coupler device can be employed, but this device still requires additional active electronic circuitry and a secondary connection to the power source.

SUMMARY OF THE INVENTION

Accordingly, the invention provides a satellite radio antenna with improved loss characteristics. In one embodiment, the invention provides a passive glass-mounted coupler capable of efficiently coupling RF energy through a dielectric panel, without the aid of additional electronic circuits for power. The coupler includes an externally mounted antenna connected to the external unit of the glass-mounted coupler. The internal unit of the glass-mounted coupler mounts on the interior glass surface, juxtaposed with the external unit mounted on the external glass surface. The output of the glass-mounted coupler feeds into the input of a low-noise amplifier ("LNA"), which is contained within the housing of the interior unit. The output of the LNA is connected to a coaxial cable, which feeds into the input of a radio receiver. The radio receiver sends a DC signal through the coaxial cable to power the LNA.

In another embodiment, the invention provides an antenna system operable to receive satellite-transmitted signals and terrestrial-transmitted signals, and effectively couple the RF energy of both signals through a dielectric panel (such as a glass panel) using two passive glass-mounted couplers. Each coupler includes an internal unit, mounted on the interior glass surface, juxtaposed with an external unit mounted on the external glass surface. The output of each coupler feeds into one of two LNAs, which is located in the interior housing that encases the internal units.

In another embodiment, the invention provides a radio frequency coupler operable to efficiently couple signals from one side of a dielectric panel to another side. The coupler includes two substantially identical conductive plates, each having an opening of finite dimensions and configuration, and each having a feed point. A first conductor of a first two-conductor transmission line is connected to the first conductive plate, while a second conductor of the first two-conductor transmission line is connected to a first isolated conductive member that extends into the first opening of the first plate. A first conductor of a second two-conductor transmission line is connected to the second plate, while a second conductor of the second transmission line is connected to a second isolated conductive member that extends into the second opening of the second plate. The conductive plates are placed in juxtaposition on opposite sides of the dielectric panel with the isolated conductive members oriented in opposition.

In another embodiment, the invention provides an antenna system that efficiently couples an external radio frequency signal through a dielectric panel to an internal radio frequency amplifying device. The system includes a first conductive plate having an opening of finite dimensions. A first conductive member extends into the opening and is coupled to an external antenna by the center conductor of a transmission line. A shield of the transmission line is coupled to the first conductive plate. The system also includes a second conductive plate having an opening of finite dimensions.

A second conductive member extends into the opening and is coupled to a radio frequency amplifying device by the center conductor of another transmission line. A shield of the other transmission line is coupled to the second conductive plate. Both conductive plates are placed in juxtaposition on opposite sides of a dielectric panel with the conductive members oriented in opposition.

In another embodiment, the invention provides a method of coupling radio frequency energy through a dielectric panel having a first surface and a second surface. The method includes the steps of positioning a first radio frequency coupling module on the first surface of the dielectric panel such that a conductive member contacts the dielectric panel. The method also includes the step of creating a radio frequency cavity at least partially around the conductive member to reduce signal leakage. The method also includes positioning a second radio frequency coupling module on the second surface of the dielectric panel such that another conductive member contacts the dielectric panel and is juxtaposed with the first conductive member, with the probes of the modules is opposition. The method also includes the step of creating another radio frequency cavity at least partially around the second conductive member.

As is apparent from the above, it is an advantage of the invention to provide a method and system of coupling radio signals through a dielectric exhibiting relatively low insertion losses. Other features and advantages of the invention will become apparent by consideration of the detailed description and accompanying drawings.

DETAILED DESCRIPTION OF THE PREFFERRED EMBODIMENTS

Figure 1:
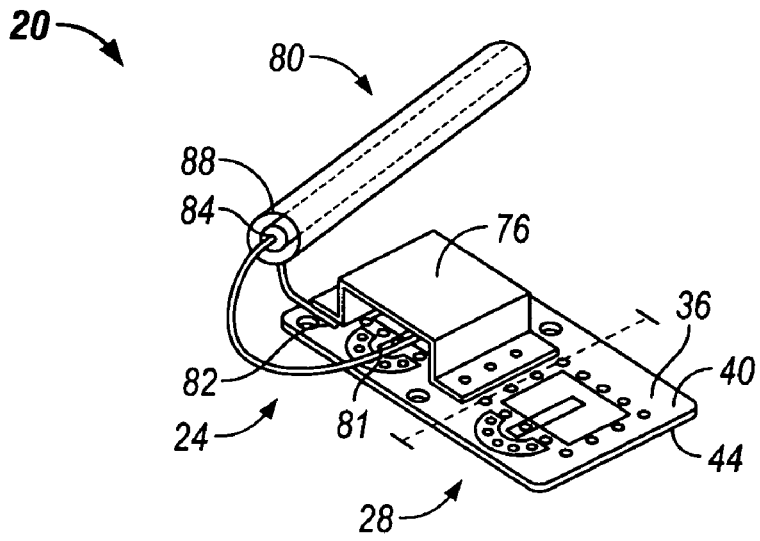
FIG. 1 illustrates a perspective view of a coupler device of the invention.
Figure 2:
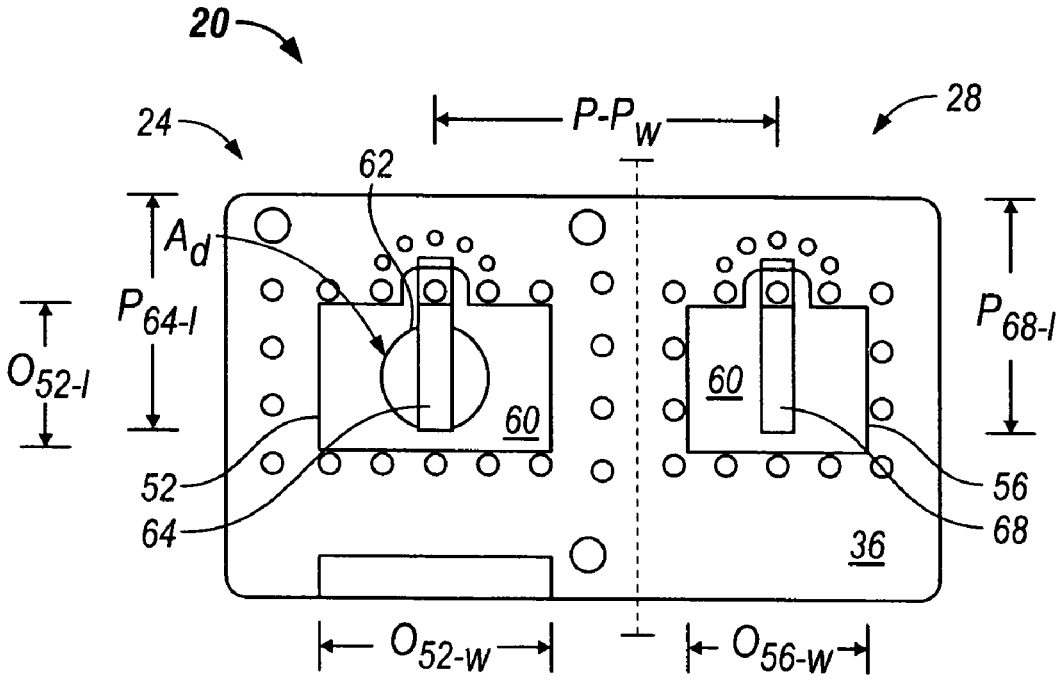
FIG. 2 is a bottom view of the coupler unit illustrated in FIG. 1.
Figure 3:
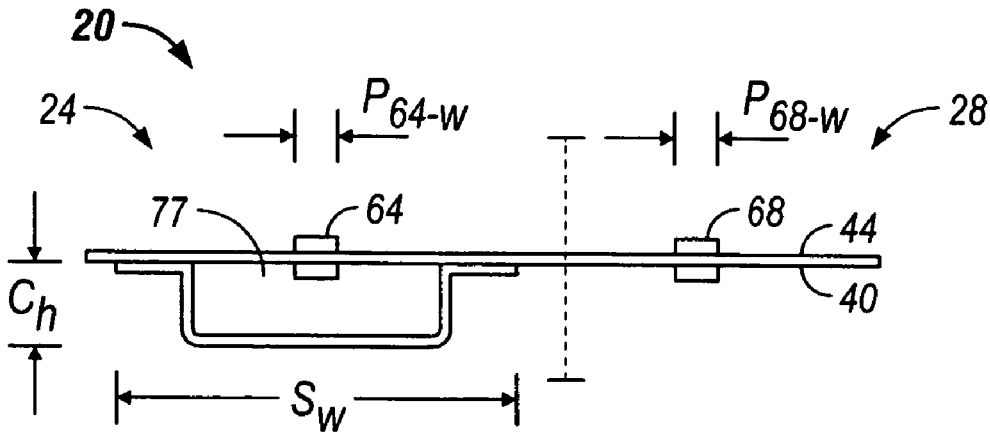
FIG. 3 is a side view of the coupler unit illustrated in FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting, and coupling. Further, "connected" and "coupled" are not restricted to physical or mechanical connections or couplings. The use of the term "radio frequency" refers to the portion of the electromagnetic spectrum that is between the audio-frequency portion (approximately 15 kHz to 20 kHz) and the infrared portion (approximately 300 GHz).

FIGS. 1–5 illustrate an exemplary radio frequency ("RF") coupling unit 20 of the invention. Two RF coupling units 20 are employed in the passive, glass-mounted coupler of the embodiment shown. In use, one RF coupling unit 20 is positioned on the exterior of a dielectric panel, such as a vehicle window, and a second RF coupling unit 20 is positioned on the interior of the dielectric panel. Both couplings units are placed in juxtaposition with their corresponding probes in opposition as is described below. In one embodiment, each unit includes components to permit the coupler to handle signals in two different frequency bands, such as terrestrial-based signals and satellite-transmitted signals. However, the invention is not limited to such an embodiment.

As shown, the RF coupling unit 20 includes two different coupling modules (separated by the broken line in FIGS. 1, 2, 3, and 5) sharing a common ground in the form of a plate. The RF coupling unit 20 has a first RF coupling module 24, which is configured to couple satellite-transmitted signals, and a second RF coupling module 28, which is configured to couple terrestrial-transmitted signals. In other embodiments, the coupler includes a coupling unit 20 configured with a single module and designed to handle signals in a single frequency range or bandwidth.

In the embodiment shown, the coupling unit 20 includes a conductive or main plate 36 with finite overall dimensions and configurations, and having a non-coupling side or top side 40 and a coupling side or bottom side 44. The main plate 36 is made from a suitable conductive material and when the unit 20 is in operation, acts as a ground. In the exemplary embodiment, both RF coupling modules 24 and 28 share the same main plate 36. In other embodiments, the RF coupling modules 24 and 28 can be two separate units, and may or may not share a common potential or ground.

The main plate 36 defines two openings 52 and 56 (opening 52 is found on the RF coupling module 24 and opening 56 is found on the RF coupling module 28), each of finite dimensions and configurations. A filler 60 of dielectric material may be placed in the openings 52 and 56. The filler 60 may take the form of a sheet of dielectric material (e.g., plastic) and that sheet may include one or more apertures, including a circularly shaped, centrally positioned aperture 62, which is preferred. The openings 52 and 56 can vary in shape and size, but are illustrated in FIGS. 1–5 as being substantially rectangular. In other embodiments, the openings 52 and 56 are circular.

Figure 4:
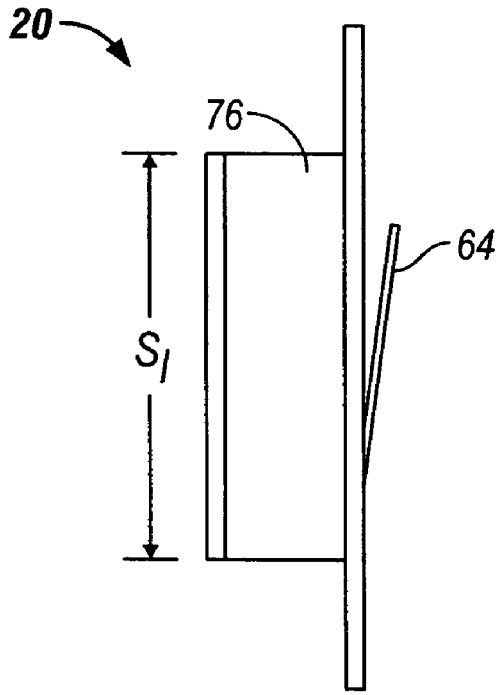
FIG. 4 is an end view of the coupler unit illustrated in FIG. 1.
Figure 5:
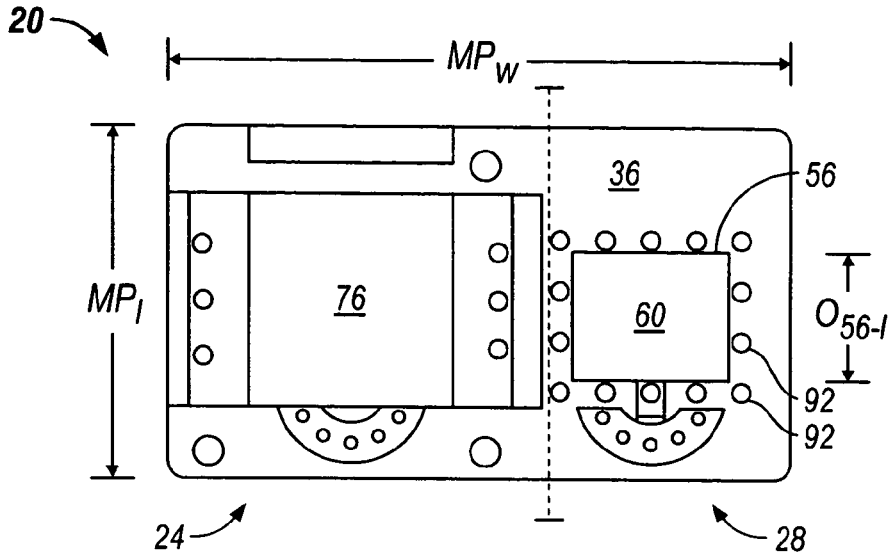
FIG. 5 is a top view of the coupler unit illustrated in FIG. 1.

Each RF coupling module 24 and 28 has a conductive member or probe 64 and 68, respectively, that extends under the filler 60 placed in the openings 52 and 56, respectively. From a plan or bottom view (FIG. 2), the probes 64 and 68 appear to extend into the openings 52 and 56, respectively, at a finite distance. However, it is preferable, as shown in FIG. 4, that the probes 64 and 68 extend into a plane slightly above the openings 52 and 56. The probes 64 and 68 are biased such that they are slightly angled when compared to the main plate 36. The probes 64 and 68 are positioned such that a portion of each probe 64 and 68 contacts the surface of a dielectric material (discussed below) when the coupler modules 24 and 28 are mounted on the subject panel of dielectric material. The probes 64 and 68 are also electrically isolated from the main plate 36. In the embodiment shown, the probes 64 and 68 are positioned on the bottom side 44 of RF coupling unit 20.

A metallic shield 76 is placed in close proximity and electrically connected to the main plate 36 on the top side 40 of RF coupling module 24. The metallic shield 76 substantially covers the non-coupling side 40 of the module 24 and the aperture 62 of filler 60. The shield 76 reduces RF signal leakage by creating a RF cavity 77 (FIG. 1). The inventor(s) found that RF signal leakage causes additional losses for the coupler when coupling signals in satellite-transmitted frequency ranges.

The RF coupling modules 24 and 28 are electrically linked to other components (not shown) in the antenna and coupler system by wires, transmission lines, or, in some embodiments, two-conductor links. In the embodiment shown, a two-conductor transmission line in the form of a coaxial cable 80 is used as the electrical link for RF coupling module 24. In one embodiment, the coaxial cable 80 has an impedance of approximately 50 ohms. The coaxial cable 80 is connected to the coupling module 24 at a corresponding feed point. The feed point includes two connections 81 and 82. The first connection 81 electrically connects a first conductor or center conductor 84 of the coaxial cable 80 to the probe 64. The second connection 82 electrically connects a second conductor or shield 88 of coaxial cable 80 to the main plate 36 of RF coupling module 24 near the opening 52. A second coaxial cable (not shown) is used as the electrical link for RF coupling module 28 in a similar manner as described above.

When in operation, a low insertion loss is achieved by a coupler having two coupling units 20 due to improved contact of the probes 64 and 68 with the panel of dielectric material. It was also found that insertion losses are reduced due to the size and shape of the probes 64 and 68, the dimensions and dielectric characteristics of the aperture 62 (combination of air and the filler 60 of dielectric material), and the presence of the shield 76. The dielectric characteristics of the aperture 62 may be adjusted through the use or non-use of the filler 60, the choice of the material used for the filler 60, and the sizing and quantity of apertures in the filler 60, such as the aperture 62.

Preferably, the dimensions and configurations of the openings 52 and 56 and the probes 64 and 68 are chosen to provide impedance matching between the coupling unit 20 and the transmission line or coaxial cable 80, which decreases the voltage standing wave ratio ("VSWR"). Furthermore, the position and configuration of the metallic shield 76 as well as the size and configuration of the main plate 36 also are chosen to improve impedance matching between the coupling unit 20 and coaxial cable 80, and thus improve efficiency. The invention can achieve an input and output VSWR of approximately 1.5:1 or less and insertion losses of ½ dB or less, while operating over approximately a 9% bandwidth. In another embodiment, the filler 60 of dielectric material found in both RF coupling modules 24 and 28 can be removed, leaving the opening 56 in RF coupling module 28 and the opening 52 in RF coupling module 24 empty.

In one embodiment of the invention, the coupler may be sized according to the dimensions listed in Table 1:

TABLE 1

| | | |
|---|---|---|
| Main Plate 36 | | |
| width | $MP_w$ | 2.90 in. |
| length | $MP_l$ | 1.71 in. |
| Probes 64 and 68 | | |
| stance from edge of main plate 36 to the tip of probe 64 | $P_{64\text{-}l}$ | 1.064 in. |
| width of probe 64 | $P_{64\text{-}w}$ | 0.125 in. |
| stance from edge of main plate 36 to the tip of probe 68 | $P_{68\text{-}l}$ | 1.064 in. |
| width of probe 68 | $P_{68\text{-}w}$ | 0.125 in. |
| width between probe 64 and probe 68 | $P\text{–}P_w$ | 1.38 in. |
| Openings 52 and 56 | | |
| length of opening 52 | $O_{52\text{-}l}$ | 0.64 in. |
| width of opening 52 | $O_{52\text{-}w}$ | 1.26 in. |
| length of opening 56 | $O_{56\text{-}l}$ | 0.64 in. |
| width of opening 56 | $O_{56\text{-}w}$ | 0.83 in. |
| Aperture 62 | | |
| diameter | $A_d$ | 0.438 in. |
| Shield 76 | | |
| length | $S_l$ | 1.00 in. |
| width | $S_w$ | 1.02 in. |
| height of RF cavity 77 | $C_h$ | 0.36 in. |

In one embodiment of the invention, the main plate 36 may be a printed circuit board ("PCB") with a layer of copper on both sides 40 and 44. In other embodiments, the PCB main plate 36 can include conductive traces on both sides 40 and 44. In the PCB embodiment, there are several pins 92 (FIG. 5) found in the main plate 36. The pins 92 create a common grounding between the sides 40 and 44 of the PCB main plate 36. The probes 64 and 68 are, in one embodiment, made from a tempered metallic material or other suitable conductive material, such as copper, and provide a means to couple the electrical RF signal from the adjacent coupler. The probes 64 and 68 are mechanically connected to plate 36 via a dielectric insulator (not shown). The probes 64 and 68 may take the form of a spring contact made of a phosphor-bronze material. The dimensions of the probes 64 and 68, the defined openings 52 and 56 and the aperture 72 are all dependent on the frequency of the signals the RF coupling modules 24 and 28 are coupling.

Figure 6:
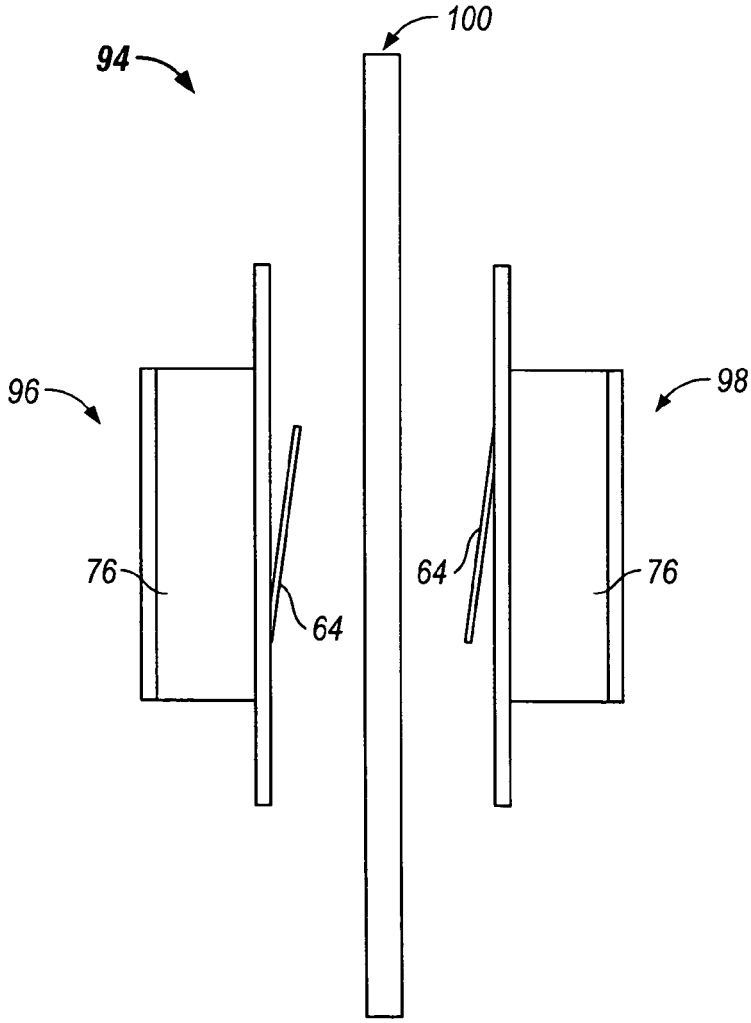
FIG. 6 is a side view of two coupler units embodying the invention.
Figure 7:
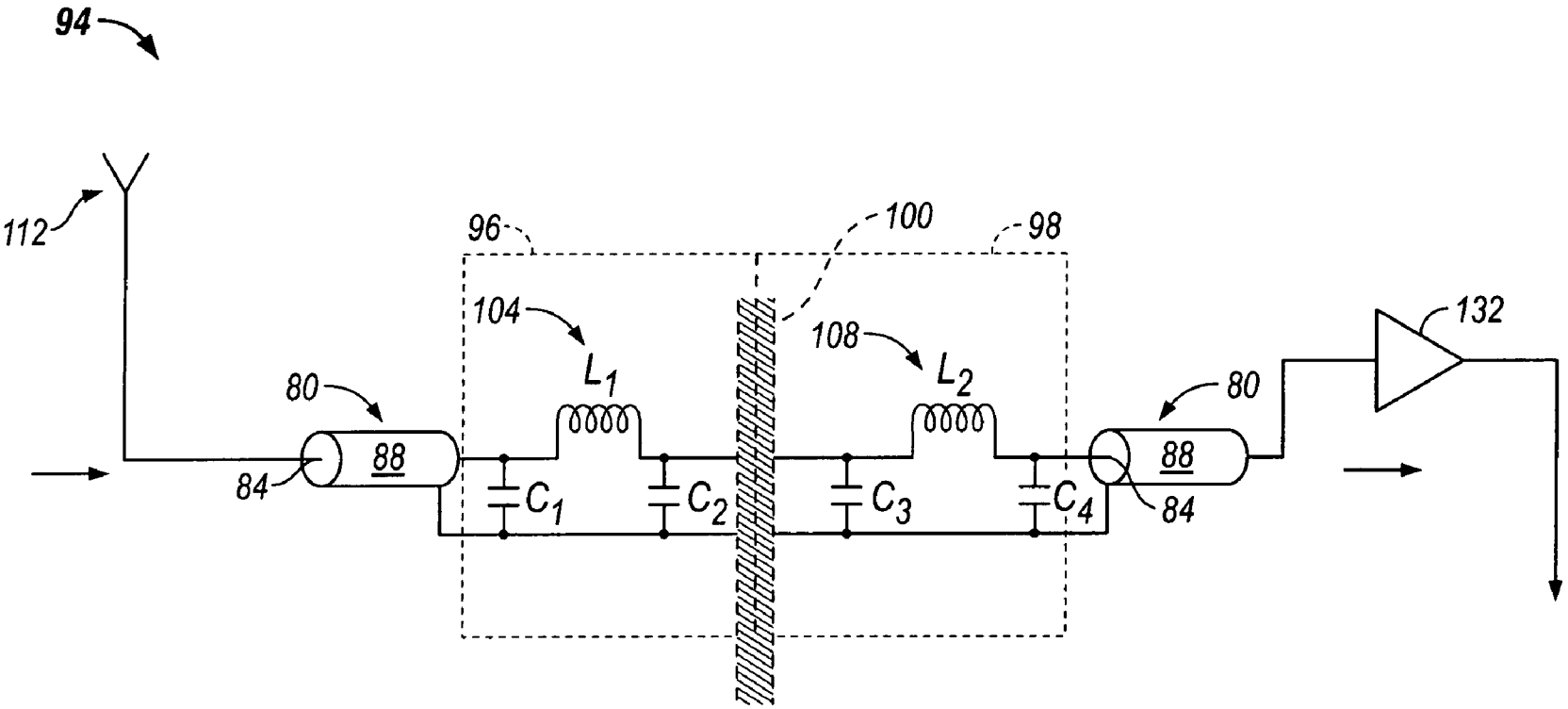
FIG. 7 is a schematic circuit diagram of one embodiment of the invention.

FIG. 6 is a side view of an RF coupler 94 embodying the invention and FIG. 7 shows a schematic circuit diagram of the RF coupler 94. The RF coupler 94 includes two RF coupling units 96 and 98. A sheet or plate of dielectric material 100 is positioned between the units 96 and 98. The units 96 and 98 are shown in perspective in FIGS. 8 and 9, respectively. The units 96 and 98 include a single coupling module that is substantially similar to the module 24 and similar elements are labeled with similar reference numerals. LC circuits 104 and 108 in FIG. 7 represent the electrical properties of each RF coupling unit 96 and 98. LC circuit 104 is a schematic representation of the exterior coupling unit 96 and LC circuit 108 is a schematic representation of the interior coupling unit 98.

Figure 8:
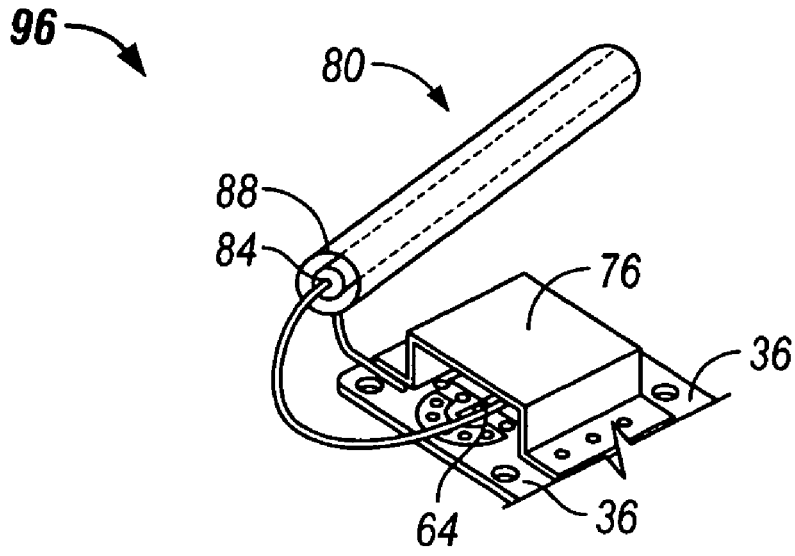
FIG. 8 illustrates a perspective view of an exterior RF coupling module of the invention.

As best seen by reference to FIGS. 7 and 8, a radiator or antenna 112 operable to receive satellite-transmitted signals is electrically linked to the probe 64 of the exterior coupling unit 96 by the center conductor 84 of the coaxial cable 80, which is preferably, relatively short. The shield 88 of the coaxial cable 80 is electrically linked to the main plate 36 of the exterior coupling unit 96. LC circuit 104 includes an inductor L1 and capacitors C1 and C2. Inductor L1 represents the inductance of the exterior RF coupling unit 96, particularly the probe 64. Capacitors C1 and C2 represent the capacitance generated by the elements within the exterior coupling unit 96 and the capacitance generated by the exterior unit 96 itself with respect to the interior unit 98.

Similar to LC circuit 104, LC circuit 108 includes inductor L2 and capacitors C3 and C4. Capacitors C3 and C4 represent the capacitance generated by the elements within the interior coupling unit 98 and the capacitance generated by the interior unit 98 itself with respect to the exterior unit 96. Inductor L2 represents the inductance property of the interior coupling unit 98. The inductive and capacitive properties of coupling units 96 and 98, illustrated as inductors L1 and L2 and capacitors C1 through C4, respectively, allows units 96 and 98 to experience mutual coupling.

As a result of this mutual coupling, the exterior coupling unit 96 is able to induce a current on the interior coupling unit 98.

Figure 9:
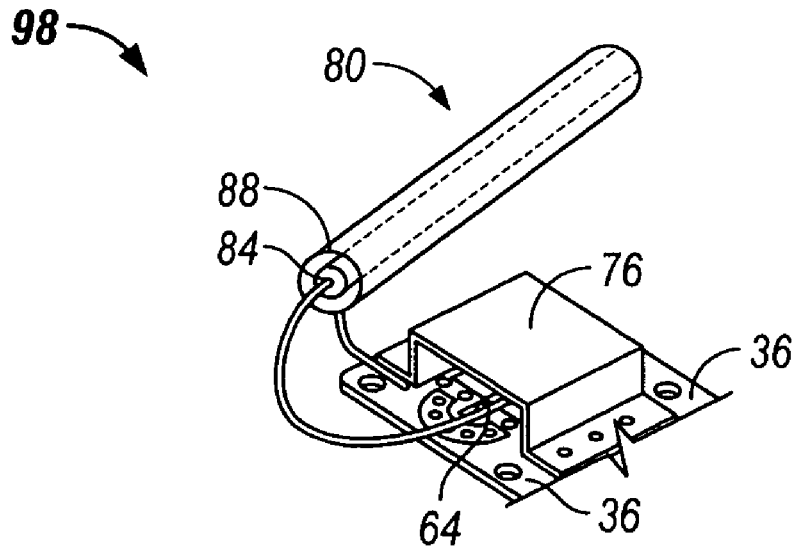
FIG. 9 illustrates a perspective view of an interior RF coupling module of the invention.

As best seen in FIGS. 7 and 9, in one embodiment, the probe 64 of the interior coupling unit 98 is electrically linked to an amplifier or a radio frequency amplifying device such as a low-noise amplifier ("LNA") 132 by the center conductor 84 of coaxial cable 80, and the main plate 36 is electrically linked to the shield 88 of coaxial cable 80. In one embodiment, the signal transmitted through the cable 80 is amplified by the LNA 132 and is fed to a receiver (not shown). In one embodiment, the receiver supplies the voltage needed to power the LNA 132.

Figure 10:
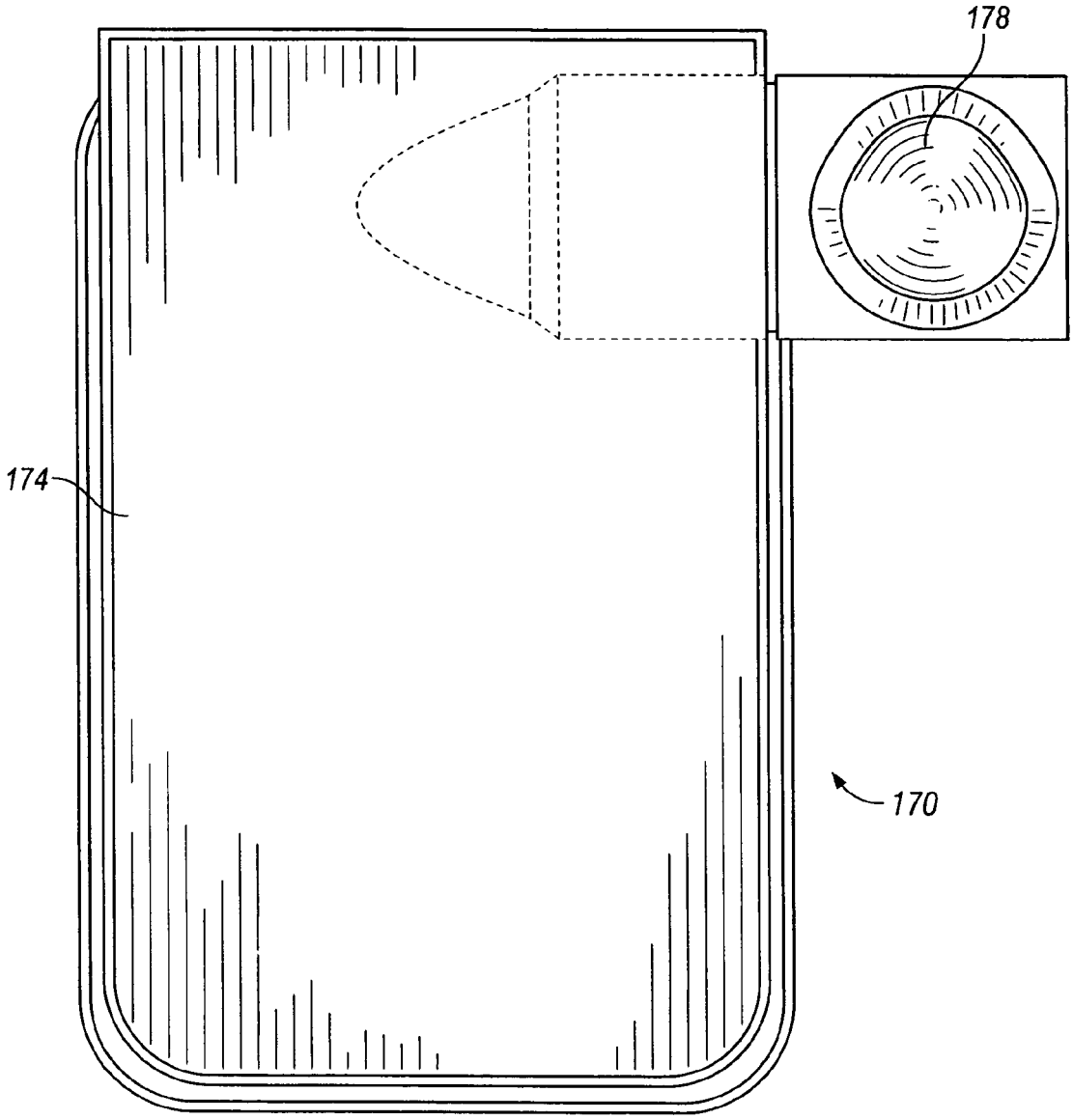
FIG. 10 illustrates a plan view of a housing for a passive antenna and a glass-mounted coupler of the invention.
Figure 11:
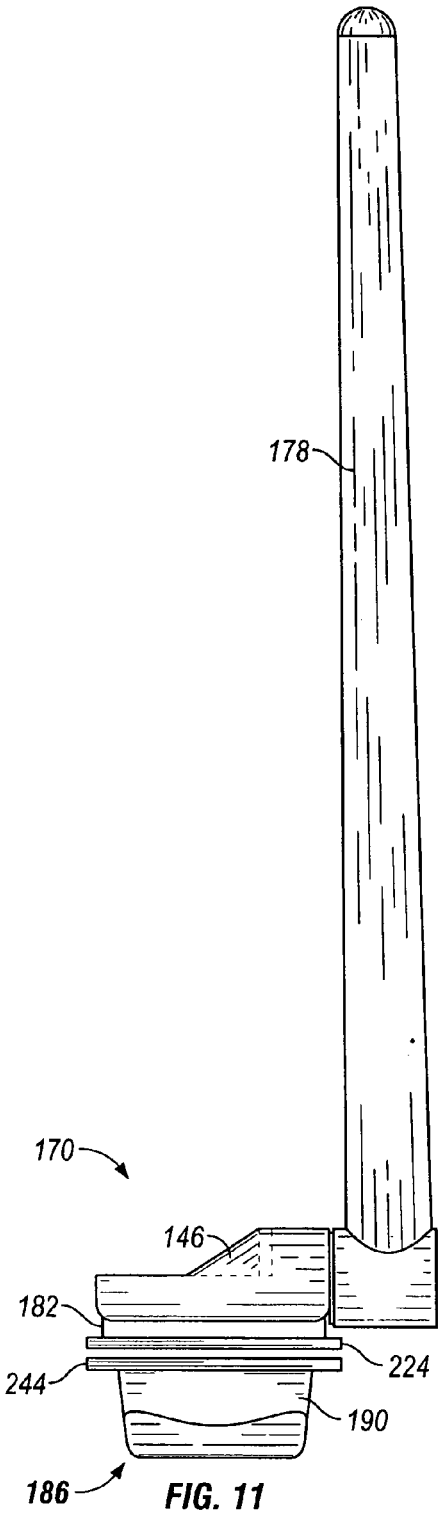
FIG. 11 is a front view of a housing for a passive antenna and a glass-mounted coupler of the invention.
Figure 12:
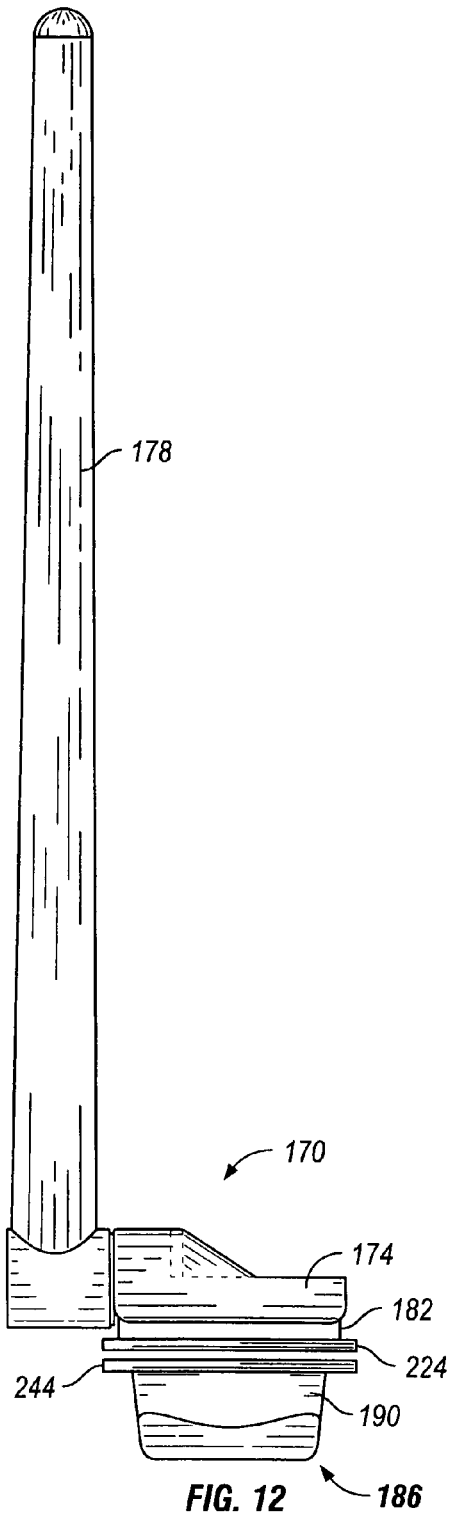
FIG. 12 is a rear view of a housing for a passive antenna and a glass-mounted coupler of the invention.
Figure 13:
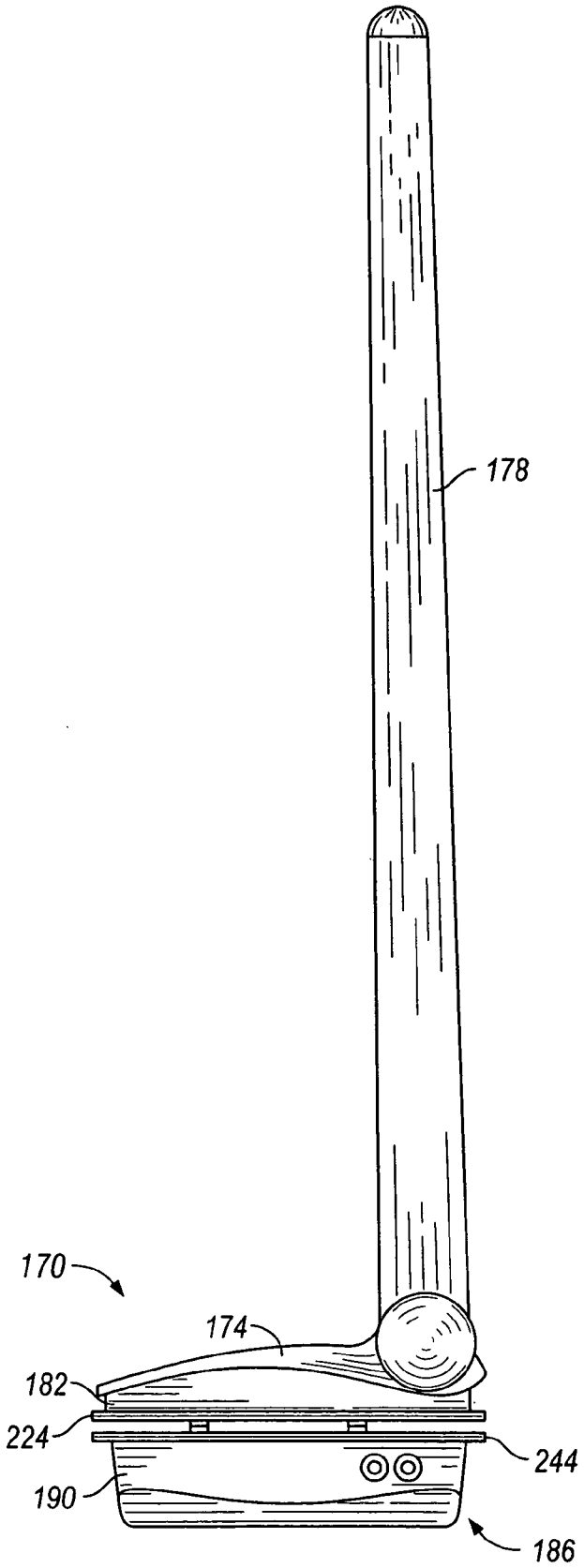
FIG. 13 is a side view as seen from the left of a housing for a passive antenna and a glass-mounted coupler of the invention.

FIGS. 10–13 illustrate housing compartments used to house the exemplary glass-mounted coupler and passive antenna shown. A plan view of the external housing compartment 170 is shown in FIG. 10. In the embodiment shown, the external housing compartment 170 includes a main cover 174, an antenna housing 178, and a relatively flexible, interface or surrounding cover 182. These elements of the external housing compartment 170 are shown in the additional elevation views illustrated in FIGS. 11–13. In other embodiments, the external housing compartment 170 may be a single covering. Further, the various elements of the external housing compartment 170 may vary in shape and size. The internal housing compartment 186 of the embodiment shown includes a single main cover 190, but could also include multiple components or vary in shape and size. When assembled, the external housing compartment 170 substantially encases one coupling unit 20 (as illustrated in FIGS. 1–5) and the internal housing compartment 186 substantially encases another coupling unit 20 (as illustrated in FIGS. 1–5). Furthermore, the bottom side 44 of each coupling unit 20 is exposed when the system is assembled.

Figure 14:
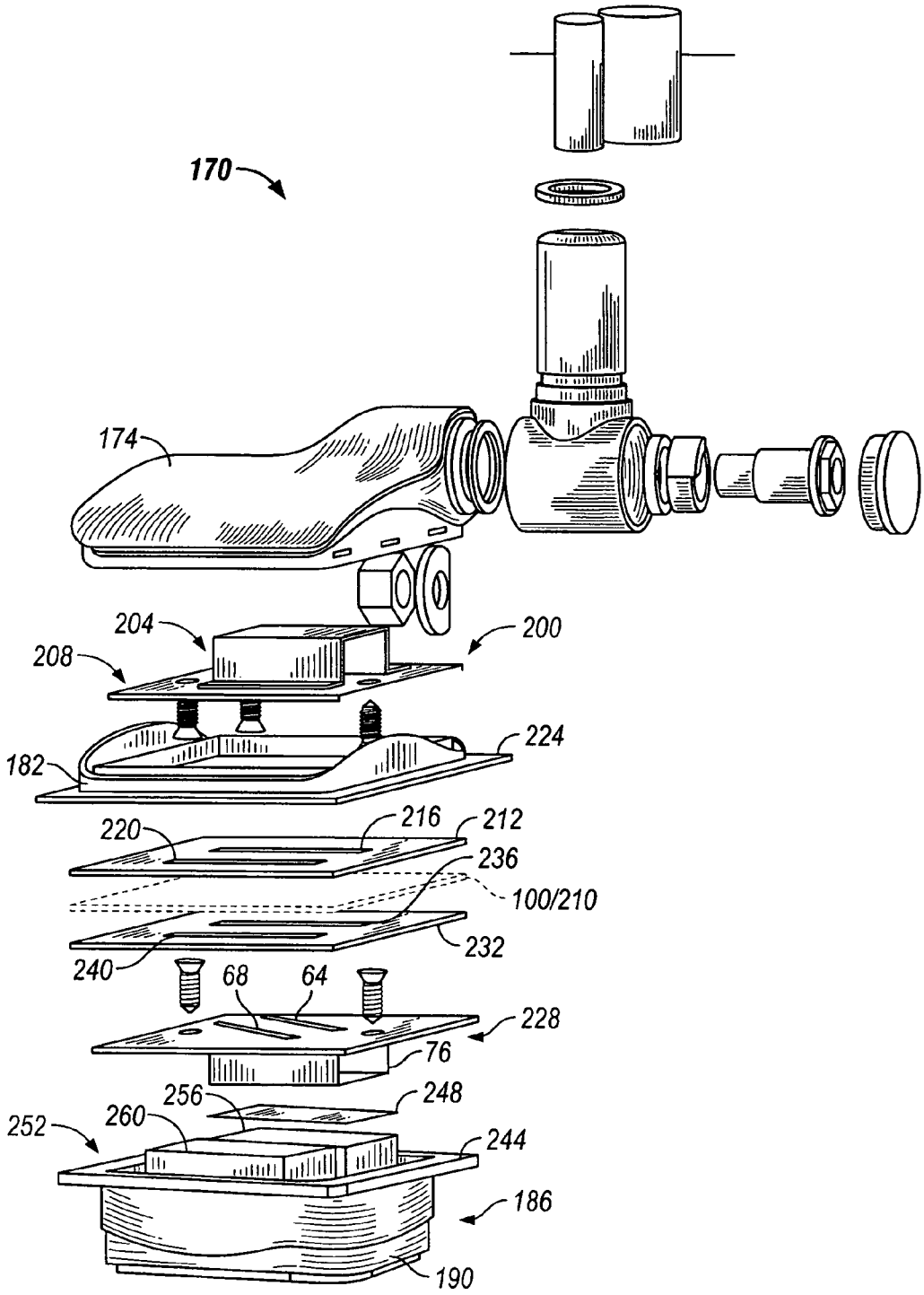
FIG. 14 is an exploded view of a passive antenna and a glass-mounted coupler assembly of the invention.
Figure 15:
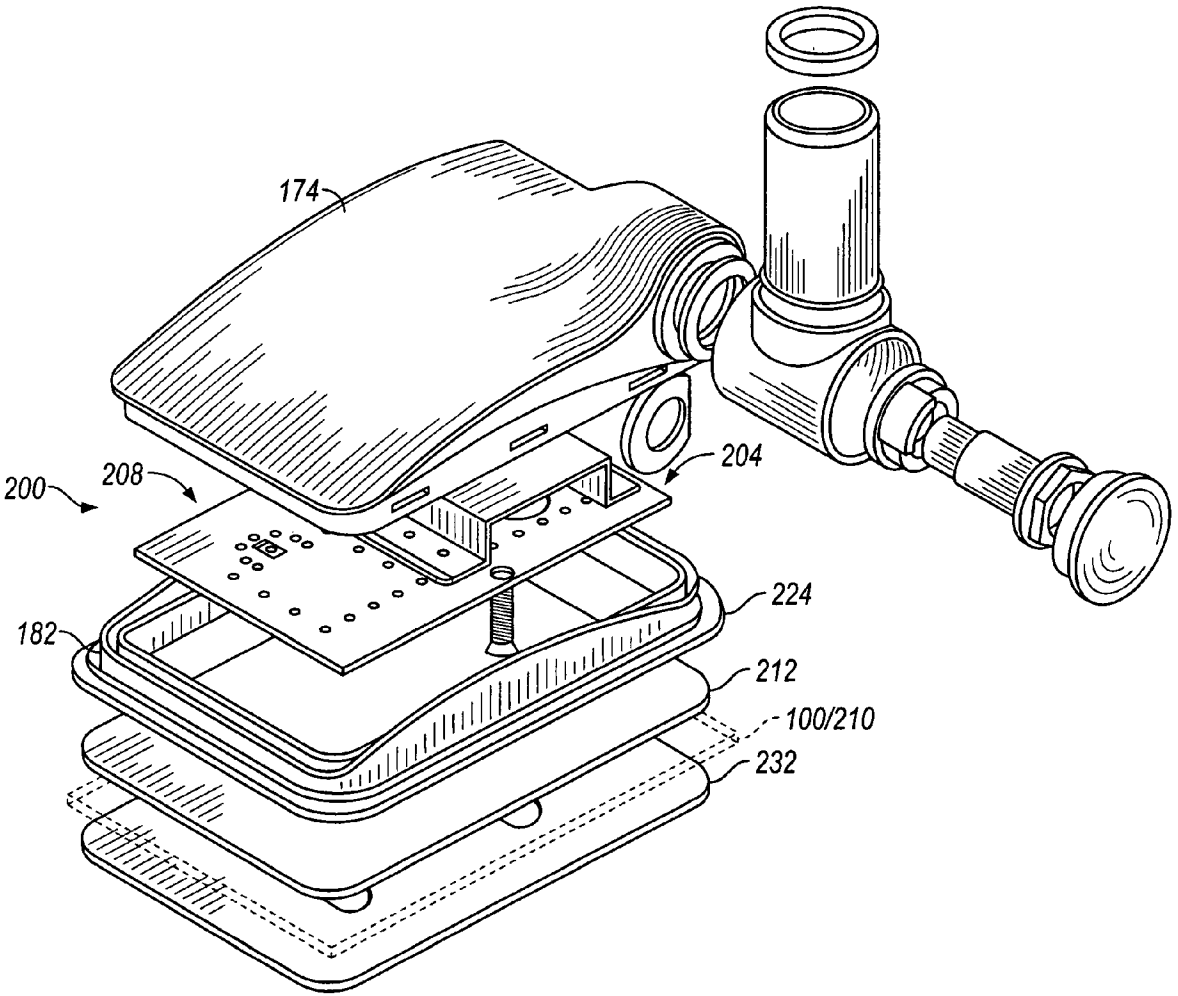
FIG. 15 is a partial, exploded view of the passive antenna and the glass-mounted coupler assembly illustrated in FIG. 11.
Figure 16:
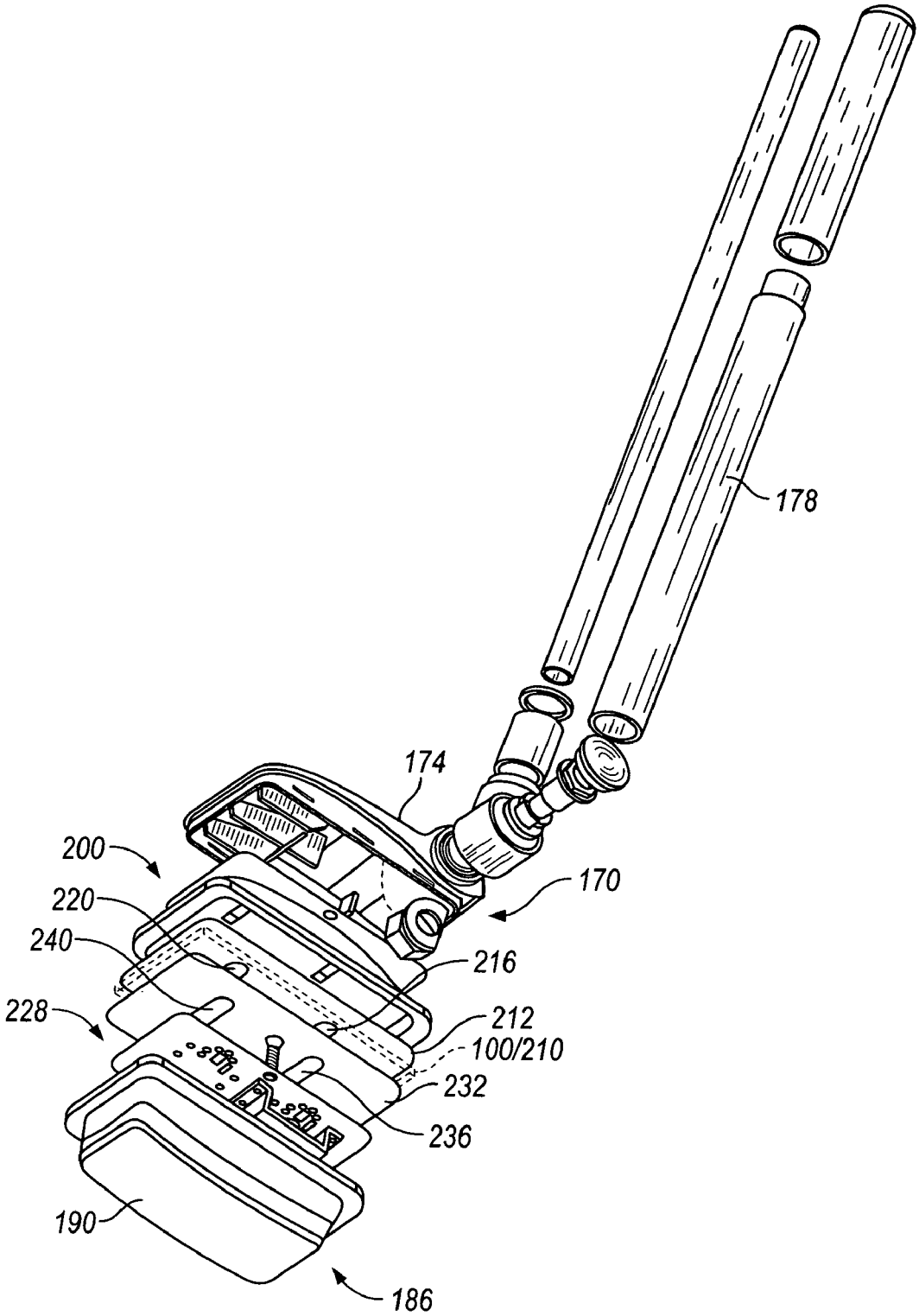
FIG. 16 is an exploded, bottom view of a passive antenna and a glass-mounted coupler assembly of the invention.

FIGS. 14–16 are exploded views of the glass-mounted coupler and passive antenna assembly discussed above. The same or like components are labeled with the same reference numbers. An exterior coupling unit 200 (exhibiting the same characteristics of coupling unit 20 in FIGS. 1–5, such as having an first coupling module for satellite-transmitted signals labeled as 204 and an second coupling module for terrestrial-transmitted signals labeled as 208), is encased by the external housing compartment 170 upon assembly with the bottom side 44 of the exterior coupling unit 200 substantially exposed. The first coupling module 204 is electrically connected to a first external radiator or antenna (not shown) encased in the antenna housing 178. Preferably, the dimensions and configuration of the probe 64 and the opening 52 in the coupling module 208 are chosen to improve impedance matching between the coaxial cable 80 and the coupling unit 200. The first antenna is circularly polarized and operable to receive satellite-transmitted signals. In the embodiment shown, the primary operational frequency band for the first antenna is between about 2.3 GHz to about 2.4 GHz. The second coupling module 208 is electrically connected to a second external radiator or antenna (not shown) encased in the antenna housing 178. In one embodiment, the second antenna is linearly polarized and operable to receive terrestrial-transmitted signals.

The external housing compartment 170 is attached to the subject dielectric panel or material 210 by a first adhesive strip 212. The first adhesive strip 212 has two apertures 216 and 220, and is at least partially positioned on a ridge 224 of the surrounding cover 182 or at least partially on the bottom side 44 of the exterior coupling unit 200 or at least partially on both. The two apertures 216 and 220 prevent the probes 64 and 68 of the exterior coupling unit 200 from being covered by the adhesive strip 212.

An interior coupling unit 228 exhibiting substantially the same characteristics of coupling unit 20 in FIGS. 1–5 is encased by the internal housing compartment 186 upon assembly with the bottom side 44 of the interior coupling unit 228 substantially exposed. Preferably, the probe 64 and opening 52 of the coupling module within the coupling unit 228 are chosen to improve impedance matching between the coaxial cable 80 (or other transmission link) and the coupling unit 200. A second adhesive strip 232 with two apertures 236 and 240 attaches the internal housing compartment 186 to the subject dielectric panel 210. The second adhesive strip 232 is placed at least partially on a ridge 244 of main cover 190 or at least partially on the bottom side 44 of the interior coupling unit 228 or at least partially on both. The two apertures 236 and 240 prevent the probes 64 and 68 from being covered by the adhesive strip 232. A third adhesive strip 248 is placed substantially on the metallic shield 76 of interior coupling module 228 to adhere the coupling unit 228 to the LNA board 252, which contains an LNA circuit 256 for satellite-transmitted signals and an LNA circuit 260 for terrestrial-transmitted signals. When installed, the dielectric material 210 is positioned between adhesive strips 212 and 232.

Figure 17A:
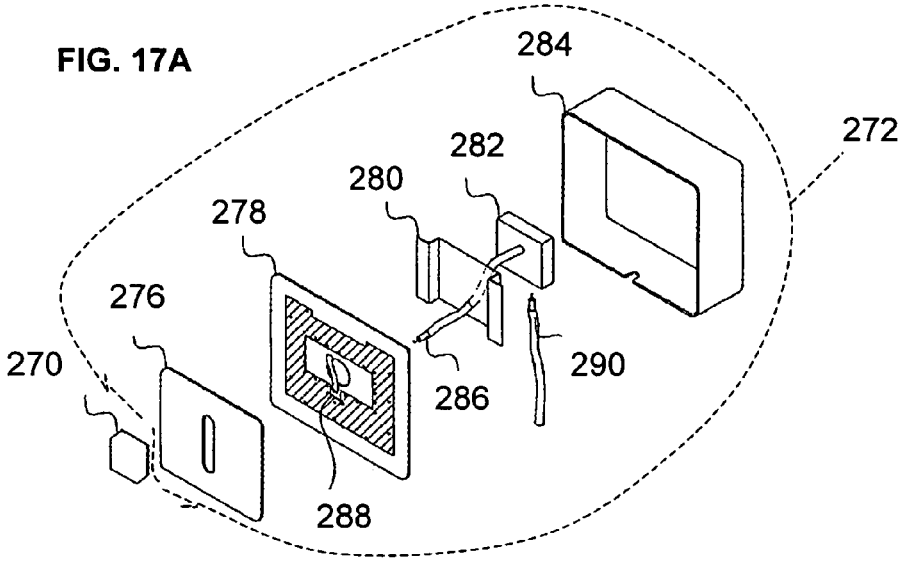
FIG. 17A is an exploded view of a passive window patch antenna and a glass-mounted coupler assembly embodiment, with FIG. 17B illustrating an exemplary circularly polarized conductive trace utilizing automobile window glass as a substrate for the circularly conductive trace as shown in FIG. 17C in accordance with the invention.
Figure 17B:
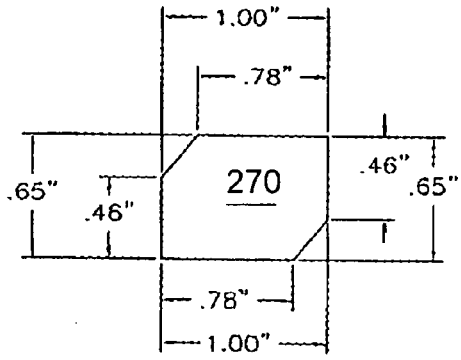
Figure 17C:
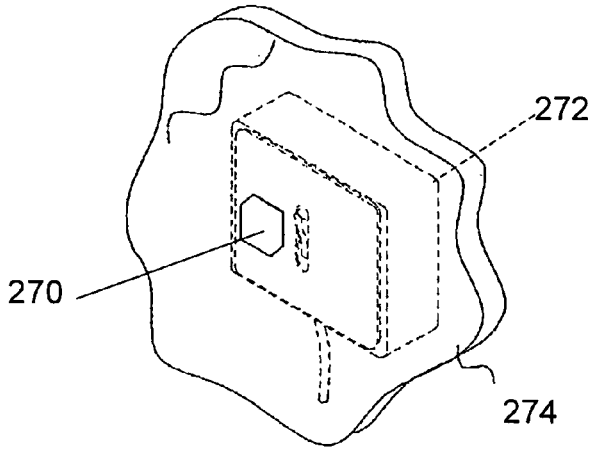

With reference to FIGS. 17A–C, the imbedded on-glass embodiment is illustrated, in which FIG. 17A is an exploded view of a passive window patch antenna and a glass-mounted coupler assembly. FIG. 17B illustrates an exemplary circularly polarized conductive trace utilizing automobile window glass as a substrate for the circularly conductive trace as shown in FIG. 17C. The RF coupling assembly is operable to couple radio frequency signals through a dielectric material having a first surface and a second surface, which utilizes the automobile window glass as a substrate for the circularly polarized conductive trace instead of using a separate ceramic patch antenna including an output port. The glass patch is electromagnetically coupled with the probe of the interior coupling unit thus replacing conventional external coupling units. In use, one RF coupling module 270 is positioned on the exterior of a dielectric panel vehicle window glass 274, and a second RF coupling module 272 is positioned on the interior of the dielectric panel glass 274. The first coupling module 270 includes a conductive member, wherein a portion of the conductive member is operable to contact the dielectric material of the panel vehicle window glass 274. The second radio frequency coupling module 272 is mountable on the second surface of the dielectric material, at the interior surface of the vehicle window glass 274. Both couplings modules are juxtaposed as discussed herein.

The RF coupling module 270 provides a first passive RF coupling configured to couple satellite-transmitted signals, which comprises a conductive trace with an adhesive backing. The RF coupling module 270 thus performs as circularly polarized radiator conductive trace antenna patch with an adhesive backing. The passive RF coupling module 270 is adhered to the external surface of an automobile window glass 274 which performs as the dielectric substrate. The reduction of size and number of components external to the vehicle augments reliability with lower feed losses.

Preferably, the trace of RF coupling module 270 is attached near the upper portion of front or rear windows, which typically have slant angles in the order of 22 degrees or less. Even though the window patch antenna is not in an optimal horizontal position, in most installations the radiation characteristics are suitable for the reception of satellite radio frequency signals. The configuration of the trace is designed to produce a circularly polarized radiation pattern, and a good impedance match when fed by an internal coupler which comprises items 276–290 (FIG. 17A). For XM Satellite Radio reception in the frequency range of 2.332 to 2.345 GHz, the dimensions of the exemplary trace of the present described embodiment of FIG. 17B are as follows, for a glass thickness of 0.185 inches:

A=1.00"
B=0.78"
C=0.46"
D=0.65"

This configuration achieves a unidirectional circularly polarized radiation pattern exhibiting a gain of approximately 4.0 dBic, and a 3 dB beamwidth of 112 degrees.

The second coupling module 272 indicated in dashed lines in FIG. 17A includes a conductive or main plate provided as a printed circuit board (PCB) 278 coupler having a conductive trace member, i.e., probe 288 with finite overall dimensions and configurations, and having a non-coupling side or top side and a coupling side or bottom side. The conductive plate PCB 278 adheres to the window glass 274 with an adhesive pad 276.

The adhesive pad 276 secures the coupler PCB 278 to the internal surface of the window in proper orientation to RF coupling module 270. The PCB 278 coupler includes conductive surfaces on both sides, with an essentially rectangular opening exposing the dielectric substrate with the probe 288 located within the aperture. The opposite conductive surfaces are electrically connected together by a series of solder plated holes around the exposed aperture. The aperture size and the dimensions of the probe are chosen to efficiently couple RF energy at a specified frequency range to the external radiating element. A metallic shield 280 is electrically connected to the conductive trace on the internal surface of the PCB 278, in order to reduce the insertion loss of the coupler.

The conductive plate PCB 278 defines an opening shown on the second RF coupling module 272 of finite dimensions and configuration. As discussed previously, a filler of dielectric material may be placed in the opening which can vary in shape and size. The conductive member or probe 288 extends into the opening. From a plan or bottom view, e.g., see FIGS. 2–4, probe 288 similarly as with probes 64 and 68 extends into the respective openings a finite distance. In FIG. 17A, a metallic shield 280 is placed in close proximity and electrically connected to the conductive plate 278. The metallic shield 280 substantially covers the non-coupling side of the module 272. The shield 280 reduces RF signal leakage by creating a RF cavity.

The conductive plate PCB 278 includes suitable conductive material on its perimeter to operate as a ground that electrically isolates from the probe 288 and the shield 280, wherein a portion of the PCB 278 conductive material is operable to contact the dielectric material surface of the vehicle window glass 274. The first radio frequency coupling module 270 and the second radio frequency coupling module 272 are thus configured such that when the modules are mounted to the dielectric material 274, the conductive member of the first radio frequency coupling module 270 is capable of being substantially in juxtaposition with the probe 288 of the second radio frequency coupling module 272, wherein the first radio frequency coupling module 270 and the shield of the second radio frequency coupling module 272 in combination form a radio frequency cavity.

The RF coupling module 272 is electrically linked to other components in the antenna and coupler system by wires, transmission lines and like two-conductor links. For example, a two-conductor transmission line in the form of coaxial cables 286 and 290 is used as the electrical link for RF coupling module 24. These coaxial cables typically have an impedance of approximately 50 ohms. The coaxial cable 286, 290 are connected at corresponding feed points. When in operation, a low insertion loss is achieved by maintaining contact of the probe 288 with the panel of dielectric material 274, and insertion losses can be reduced with selection of the size and shape of the probes as discussed above. The dimensions and configurations of the opening and the probe 288 are chosen to provide impedance matching between the coupling module 272 and the transmission line or coaxial cables. Impedance matching of the coupling module 272 decreases the voltage standing wave ratio ("VSWR"), and the position and configuration of the metallic shield 280 as well as the size and configuration of the conductive plate 278 also are chosen to improve impedance matching and efficiency.

The probe 288 is connected to the center conductor of a section of coaxial cable 286. The shield of the coax 286 is connected to the conductive surface of the PCB 278, in close proximity to the feed point of the probe 288. The coax 286 is used for transmission of the radio frequency (RF) output from the probe 288. The opposite end of the coax 286 is connected to the input port of a low noise amplifier (LNA) 282, the interior port is connected to the LNA 282 while the external port is connected to the satellite receiver, with an input impedance of 50 ohms.

For Satellite Radio applications, operating in the 2.320 to 2.3456 MHz frequency range, a circularly polarized antenna is used. One such antenna is a circularly polarized ceramic (or other high dielectric) patch antenna, horizontally mounted on a small ground plane with radiation characteristics covering the upper elevation angles, with a radiation peak at approximately +45 degrees. The output of this antenna is connected to input port of the external coupling unit which is in close proximity. The output port of the LNA 282 is connected to a receiver by means of a length of coaxial transmission line, coaxial cable 290. A DC voltage also is supplied by the receiver through the coaxial cable 290, in order to energize the LNA 282. The components of the coupler 272 are contained within a housing 284 that may be made of either a conductive, or non-conductive material such as plastic.

The invention provides, among other things, a satellite radio antenna with improved loss characteristics. Various features and advantages of the invention are set forth in the following claims.

What is claimed is:

1. A radio frequency coupler operable to couple radio frequency signals through a dielectric material having a first surface and a second surface, the coupler comprising:

a first radio frequency coupling module mountable on the first surface of the dielectric material, the first coupling module including a conductive member, wherein a portion of the conductive member is operable to contact the dielectric material;

a second radio frequency coupling module mountable on the second surface of the dielectric material, the second coupling module including:

a plate having a first side, a second side, and an opening;

a shield coupled to the first side of the plate; and a conductive member electrically isolated from the plate and the shield, wherein a portion of the conductive member is operable to contact the dielectric material;

wherein, the first radio frequency coupling module and the second radio frequency coupling module are configured such that when the modules are mounted to the dielectric material, the conductive member of the first radio frequency coupling module is substantially in juxtaposition with the conductive member of the second radio frequency coupling module.

2. The coupler as set forth in claim 1, wherein the conductive member of the first radio frequency coupling module comprises a conductive trace antenna patch with an adhesive backing.

3. The coupler set forth in claim 2, wherein the second radio frequency coupling module further comprises a filler of dielectric material positioned in the opening of the plate, the filler of dielectric material having an aperture, and wherein the aperture is partially surrounded by the shield.

4. The coupler as set forth in claim 1, wherein the first radio frequency coupling module comprises a radiator.

5. The coupler as set forth in claim 4, wherein the radiator is operable to receive satellite-transmitted radio frequency signals.

6. The coupler as set forth in claim 5, wherein an operational frequency band of the coupler is from about 2.3 GHz to about 2.4 GHz.

7. The coupler as set forth in claim 4, wherein the radiator is operable to receive terrestrial-transmitted radio frequency signals.

8. The coupler as set forth in claim 1, wherein the second radio frequency coupling module is electrically connected to a low noise amplifier.

9. The coupler as set forth in claim 1, wherein the coupler is operable to achieve insertion losses of approximately ½ dB.

10. The coupler as set forth in claim 1, wherein the coupler is operable to achieve a voltage standing wave ratio of approximately 1.5:1.

11. The coupler of claim 1, wherein the first radio frequency coupling module and the shield of the second radio frequency coupling module in combination form a radio frequency cavity.

12. An antenna system operable to receive a radio frequency signal and operable to couple radio frequency energy through a dielectric panel having a first surface and a second surface, the system comprising:

a radio frequency coupler operable to couple radio frequency energy through the dielectric panel, the coupler comprising:

a first radio frequency coupling module having a conductive member including a radiator operable to receive radio frequency signals and configurable to be mounted on the first surface of the dielectric panel;

a second radio frequency coupling module having a plate defining an opening and a conductive member extending into a plane slightly above the opening, the second coupling module configurable to be mounted on the second surface of the dielectric panel in juxtaposition with the first coupling module;

a low noise amplifier coupled to the second radio frequency coupling module; and wherein the conductive member of the first radio frequency coupling module is operable to be in direct contact with the first surface of the dielectric panel when the first module is mounted on the panel, and the conductive member of the second radio frequency coupling module is operable to be in direct contact with the second surface of the dielectric panel when the second module is mounted on the panel.

13. The system as set forth in claim 12, comprising a shield positioned over the opening defined by the plate and electrically coupled to the plate of the second coupling module.

14. The system as set forth in claim 12, wherein the opening defined by the plate and the conductive member of the second coupling module includes a filler of dielectric material, and wherein the second coupling module comprises the filler of dielectric material positioned in the opening with an aperture defined by the filler.

15. The system as set forth in claim 12, wherein the coupler is operable to achieve insertion losses of approximately ½ dB.

16. The system as set forth in claim 12, wherein the coupler is operable to achieve a voltage standing wave ratio of approximately 1.5:1.

17. The system as set forth in claim 12, wherein the radiator is operable to receive terrestrial-transmitted radio frequency signals and wherein the antenna is linearly polarized.

18. The system as set forth in claim 12, wherein the radiator is operable to receive satellite-transmitted radio frequency signals and wherein the antenna is circularly polarized.

19. An antenna system operable to receive a satellite radio frequency signal and a terrestrial radio frequency signal, the system also operable to couple radio frequency energy through a dielectric panel having an exterior surface and an interior surface, the system comprising:

a first radio frequency coupler operable to couple a signal through the dielectric panel, the first coupler comprising:

a first exterior radio frequency coupling module having a conductive member electrically including a first external radiator operable to receive a satellite radio frequency signal configurable to be mounted on the exterior surface of the dielectric panel;

a first interior radio frequency coupling module having a plate defining an opening and a conductive member extending into a plane slightly above the opening, the first interior module configurable to be mounted on the interior surface of the dielectric panel in approximate juxtaposition with the first exterior coupling module;

a second radio frequency coupler operable to couple a signal through the dielectric panel, the second coupler comprising:

a second exterior radio frequency coupling module having a conductive member electrically including a second external radiator operable to receive a terrestrial radio frequency signal configurable to be mounted on the exterior surface of the dielectric panel; and a second interior radio frequency coupling module having a plate defining an opening and a conductive member extending into a plane slightly above the opening, the second interior coupling module operable to be mounted on the interior surface of the dielectric panel in approximate juxtaposition with the second exterior coupling module;

a first interior low noise amplifier coupled to the first radio frequency coupler; and a second interior low noise amplifier coupled to the second radio frequency coupler.

20. The system as set forth in claim 19, wherein the first coupler is operable to achieve insertion losses of approximately ½ dB.

21. The system as set forth in claim 19, wherein the first coupler and second coupler are operable to achieve a voltage standing wave ratio of approximately 1.5:1.

22. The system as set forth in claim 19, wherein the conductive member of the first exterior module is configurable to be in direct contact with the dielectric panel when the first exterior module is mounted on the panel;

the conductive member of the second exterior module is configurable to be in direct contact with the dielectric panel when the second exterior module is mounted on the panel;

the conductive member of the first interior module is configurable to be in direct contact with the dielectric panel when the first interior module is mounted on the panel; and the conductive member of the second interior module is configurable to be in direct contact with the dielectric panel when the second interior module is mounted on the panel.

23. A method of coupling radio frequency energy through a dielectric panel having a first surface and a second surface, the method comprising:

positioning a first radio frequency coupling module comprising a conductive member in contact with the first surface of the dielectric panel;

positioning a second radio frequency coupling module on the second surface of the dielectric panel such that a conductive member of the second radio frequency coupling module contacts the dielectric panel and is juxtaposed with the conductive member of the first radio frequency coupling module; and creating a radio frequency cavity at least partially around the conductive member of the second radio frequency coupling module.

24. The method as set forth in claim 23, wherein the act of positioning a first radio frequency coupling module in contact with the first surface of the dielectric panel, the act of positioning a second radio frequency coupling module on the second surface of the dielectric panel such that the conductive member of the second radio frequency coupling module contacts the dielectric panel and is juxtaposed with the conductive member of the first radio frequency coupling module, and the act of creating the radio frequency cavity at least partially around the conductive member of the second radio frequency coupling module produce insertion losses of approximately ½ dB.

25. The method as set forth in claim 23, further comprising:

choosing dimensions for the conductive member for the first coupling module to improve efficiency of the coupler.

26. The method as set forth in claim 25, wherein the act of choosing dimensions for the conductive member for the first coupling module to improve efficiency achieves a voltage standing wave ratio of approximately 1.5:1.

27. An antenna system for efficiently coupling an external radio frequency signal through a dielectric panel to an internal device, the system comprising:

a first conductive member comprising an external patch antenna;

a radio frequency amplifying device;

a conductive plate with finite overall dimensions and configuration having an opening of finite dimensions and configuration;

a second conductive member extending into the opening of the conductive plate at a finite distance;

a transmission line having a shield and a center conductor, wherein the shield is coupled to the conductive plate at a first connection near the opening, and the center conductor couples the radio frequency amplifying device to the second conductive member at a second connection; and wherein the first and second conductive members are operable to be mounted on the dielectric panel such that the first conductive member is juxtaposed with the second conductive member, when mounted.

28. The system as set forth in claim 27, wherein the overall dimensions and configurations of the first conductive member contributes to the efficiency of the device.

29. The system as set forth in claim 27, wherein the first conductive member and the shield substantially cover the opening of the second conductive plate with conductive member and the shield forming a radio frequency cavity.

30. The system as set forth in claim 27, wherein a portion of the conductive member is operable to be in direct contact with the dielectric panel.

31. The system as set forth in claim 27, wherein the conductive member comprises a tempered metallic material.

32. The system as set forth in claim 27, wherein an operational frequency band of the system is approximately from 2.3 GHz to approximately 2.4 GHz.

33. The system as set forth in claim 27, wherein the antenna is a circularly polarized antenna operable to receive satellite-transmitted signals.

34. The system as set forth in claim 27, wherein the antenna is linearly polarized.

35. The system as set forth in claim 27, wherein the radio frequency amplifying device comprises a low noise amplifier.

36. The system as set forth in claim 27, wherein the conductive plate comprises a dielectric printed circuit board with conductive traces.

* * * * *